US006786073B2

(12) United States Patent
Bone

(10) Patent No.: US 6,786,073 B2
(45) Date of Patent: Sep. 7, 2004

(54) APPARATUS AND METHOD FOR ROLLING CRANKSHAFTS HAVING SPLIT-PIN BEARINGS

(75) Inventor: Bramwell W. Bone, Midland, MI (US)

(73) Assignee: Ingersoll CM Systems LLC, Midland, MI (US)

( * ) Notice: Subject to any disclaimer, the term of this patent is extended or adjusted under 35 U.S.C. 154(b) by 0 days.

(21) Appl. No.: 10/211,939

(22) Filed: Aug. 2, 2002

(65) Prior Publication Data

US 2004/0020256 A1 Feb. 5, 2004

(51) Int. Cl.[7] ..... B21D 15/00
(52) U.S. Cl. ..... 72/110; 72/107; 29/6.01
(58) Field of Search ..... 72/107, 109, 110, 72/111, 115, 118; 29/6.01

(56) References Cited

U.S. PATENT DOCUMENTS 2,841,861 A * 7/1958 Williams ..... 29/90.01
2,876,528 A * 3/1959 Wulpi ..... 29/90.01
4,299,017 A * 11/1981 Gottschalk ..... 29/90.01
4,747,286 A * 5/1988 Berstein et al. ..... 72/110
5,495,738 A * 3/1996 Gottschalk ..... 72/110
5,575,167 A * 11/1996 Gottschalk et al. ..... 72/110

FOREIGN PATENT DOCUMENTS

JP 5-253756 * 10/1993 ..... 72/110

* cited by examiner

*Primary Examiner*—Ed Tolan
(74) *Attorney, Agent, or Firm*—Fitch, Even, Tabin & Flannery

(57) ABSTRACT

An apparatus and method are provided for roll hardening of crankshafts having split-pin bearings without requiring multiple rolling stages or operations therefor. The apparatus and method herein utilize a single tool unit that varies the rolling pressure on the fillets on either side of one of the split-pin bearings such that the areas needing strengthening are simultaneously rolled with a higher pressure than those areas at which bending of fence walls between adjacent bearings can occur with high pressure rolling, despite their arcuately offset orientation relative to each other. The tool unit has a pair of rollers rotatively housed at predetermined positions so that, when engaged against the opposite fillets of a bearing, they will be at arcuately offset or spaced positions from each other about the bearing.

13 Claims, 14 Drawing Sheets

APPARATUS AND METHOD FOR ROLLING CRANKSHAFTS HAVING SPLIT-PIN BEARINGS

FIELD OF THE INVENTION

The invention relates to an apparatus and method for deep rolling of crankshafts for increasing the fatigue strength thereof and, more particularly, to a rolling apparatus and method for crankshafts having split-pin bearings.

BACKGROUND OF THE INVENTION

The principal of rolling crankshaft bearings in the fillet areas for increased fatigue strength has been known for many years. Rolling of fillet radii increases bending fatigue strength by applying compressive residual stresses into the areas below the surface of the material being rolled. The high-rolling forces however can, in certain instances, cause thin sections of metal at the sides of the bearings to bend over.

More particularly, there are radially extending side walls or fences on either side of a pin bearing for taking the side thrusts of the connecting rods of the engine pistons. As these fences extend radially beyond the outer surface of the pin bearing, the rollers can engage in the annular fillets therebetween and apply high compressive forces thereto. In this regard, the work rollers are typically angled or canted outwardly so that they can bear against these radial walls while being rolled in the fillets. As such, excessive applied force by the rollers can tend to distort or bend the radial wall portions if not properly controlled.

One way to avoid bending of the radial wall portions is to reduce the rolling force in the area where the bearings are in non-overlapping relation to each other, see, e.g. Japanese Patent Publication No. 60-24319 and U.S. Pat. No. 4,561,276. In this case, high pressure is applied by the tool actuator in the adjoinment area where the adjacent bearings are in overlapping relation and the actuator pressure is reduced in the non-overlap area where the wall is more prone to bending. The lower rolling force is sufficient to provide roll hardening to the crankshaft as it is mainly in the adjoinment area where the compressive residual strength is needed for strengthening this area of overlap between adjacent bearings.

In a conventional rolling tool, the rollers that impart the compressive residual forces are disposed generally opposite to each other and thus are angularly or circumferential aligned with respect to each other when engaged in the fillets on opposite sides of a crankshaft bearing. Therefore, when these rollers are applying the compressive rolling force to the bearing, be it at high or low levels, it is symmetrically applied to the fillet areas that are aligned and correspond to each other on either side of the bearing. Thus, when pulsing the rolling force during crankshaft rotation to avoid high pressures in the non-overlap areas prone to failure, the application of this varied force will occur symmetrically on each side of the pin bearing. In other words, the arcuate areas or surface portions of the opposite fillets that are rolled with a high force will be circumferentially aligned with each other about the bearing rolled. Similarly, those areas rolled with a lower force will likewise be aligned about the bearing.

However, a problem arises on a crankshaft having a split-pin bearing, such as on a V6-90 degree crankshaft, where the adjoinment overlap areas and non-overlap areas are not symmetrical or circumferentially aligned on each side of the pin bearings. This is because the split-pin bearings have one pin bearing that is offset arcuately from the other pin bearing, i.e. split, with these pin bearings lacking an intervening main bearing as is a common configuration for crankshafts. Thus, when taking an axial view of one of these split-pin bearings, the adjoinment overlap areas, as circumscribed by arcuate surface portions or segments of the bearings, located between it and the other pin bearing on one side thereof and the main bearing on the other side thereof will be shifted around the circumference of the one pin bearing so that these areas or arcuate surface portions are arcuately offset from each other and are not circumferentially aligned across the pin bearing from each other.

Accordingly, if a conventional rolling tool having opposite, aligned rollers are used in the fillets on either side of one of the split-pin bearings, any pulsing of the rolling force will not be able to be uniformly applied to both of the offset arcuate surface portions of the adjoinment areas on either side of the pin bearing. As such, having high forces applied by one of the opposite aligned rollers to the overlap arc surface portion at one side of one of the split-pin bearings will necessarily cause the other roller to apply high forces to a non-overlap surface portion on the other side of the pin-bearing where such surface portion is not circumferentially aligned or overlapping with the other surface portion that is being rolled with high forces. By having high rolling forces applied to bearing surface portions that circumscribe non-overlap areas of adjacent bearings, the risk of bending of the fence wall is increased, as previously discussed.

U.S. Pat. Nos. 5,495,738 and 5,575,167 disclose a two-stage process for rolling split-pin bearings in a manner that attempts to subject the adjoinment or overlap areas between adjacent bearings to a high level of rolling forces. In one stage, a pair of conventional tools having opposite, aligned rollers are employed, one on each split-pin bearing, so that their outer and inner rollers engage in respective outboard with inboard fillets on either side of the pin bearing they are to roll. These tools are independently operated so that the overlap areas on the inboard fillets of the pin bearings are rolled at higher pressures than the non-overlap areas. In the other stage, a modified tool is employed where a pair of tool housings are adjustably connected by a bearing unit therebetween. This modified tool has only outer work rollers with the inner rollers removed so as to only be able to apply rolling forces to the outboard fillets of each of the respective split-pin bearings without migration of the rollers off from the fillets in which they are engaged. Accordingly, in this stage, only the outboard fillets are rolled, either at a constant or variable pressure for roll hardening thereof.

For utilizing these two different tool units in the two stage rolling process of the '738 and '167 patents, it is disclosed that a single machine is retooled after one of the rolling stages or two machines are employed with one tooled with the conventional rolling tools and the other tooled with the double-housing tool. In either instance, there are significant inefficiencies introduced, both by the use of a two-stage rolling process for the split-pin journals and because of the use of different tooling units necessitating either retooling of a single machine between each stage of the split-pin bearing rolling operation or removing the crankshaft from one machine after the first stage and loading it into a second machine for second stage rolling.

Also, it is apparent that when rolling the inboard fillet of a split-pin bearing with conventional tools as taught by these patents, the rolling force applied to the outboard fillet on the other side of the split-pin bearing by the tools will not be properly located so that high forces are substantially confined to its adjoinment or overlap area with the main bearing adjacent thereto. Likewise, the low rolling forces will not be confined to the non-overlap area between the bearings in the outboard split-pin bearing fillet.

Accordingly, there is a need for a more efficient apparatus and method for roll hardening of crankshafts having split-pin bearings. More specifically, an apparatus and method are desired that do not require two stages for rolling the split-pin bearings for avoiding bending of the fence wall therebetween.

SUMMARY OF THE INVENTION

In accordance with the present invention, an apparatus and method are provided for roll hardening of crankshafts having split-pin bearings without requiring multiple rolling stages or operations therefor. In particular, the apparatus and method herein utilize a single tool unit that varies the rolling pressure on the fillets on either side of one of the split-pin bearings such that the areas needing strengthening are simultaneously rolled with a higher pressure than those areas at which bending of fence walls between adjacent bearings can occur with high pressure rolling, despite their arcuately offset orientation relative to each other. For this purpose, the tool unit has a pair of rollers rotatively housed at predetermined positions so that, when engaged against the opposite fillets of a bearing, they will be arcuately offset or spaced from each other about the bearing. Thus, the present tool allows the arcuately or circumferentially spaced surface portions of the respective fillets to simultaneously be subjected to high rolling forces for roll hardening thereof, whereas the arcuately or circumferentially spaced non-overlap areas at which the fence walls are prone to bend are simultaneously rolled with lower rolling forces so as to avoid bending of the radial walls. Accordingly, the crankshaft rolling apparatus and method herein employing the present tool enables split-pin bearings to be rolled with varied forces in a single rolling operation achieving significant cycle-time efficiencies over prior two-stage split-pin bearing rolling processes.

In contrast to prior tools which have their rollers aligned, the present rolling tool allows rolling pressures to be varied without causing the reverse effect in split-pin bearings from one side of the bearing to the other. In other words, the tool allows the pressure to be increased to simultaneously positively effect the areas prone to fatigue failure on both sides of the pin bearing despite their arcuate offset spacing from each other. At the same time, the tool also allows the pressure to be reduced so as not to create bending of the fence walls in those areas prone to bending on both sides of the pin bearing even though they are offset from each other.

Because the work rollers are no longer in line with each other axially across the bearing as in conventional tools, they will apply rolling force at offset areas on either side of the bearings in the fillets thereat. Since each work roller is to be applied at a circumferentially spaced position relative to the other in the respective fillets on either side of one of the split-pin bearings, it is preferable that each work roller have its own backup roller in the tool housing therefor. The tool housing can be elongated in a direction transverse to the axis of the held crankshaft and have an end from which the circumferentially offset or spaced rollers project that is configured to allow the rollers to engage in circumferentially spaced positions in the opposite fillets on either side of the split-pin bearing. In one form, the tool end from which the offset work rollers project has a V-shaped configuration so that it extends about the pin bearing to better enable the work rollers to be engaged at circumferentially spaced positions in the respective opposite fillets thereof. Accordingly, the present tool apparatus and method allow high rolling forces to be imparted to the areas where this is needed on either side of the split-pin bearing despite the offset orientation thereof.

DETAILED DESCRIPTION OF THE PREFERRED EMBODIMENTS

Figure 1A:
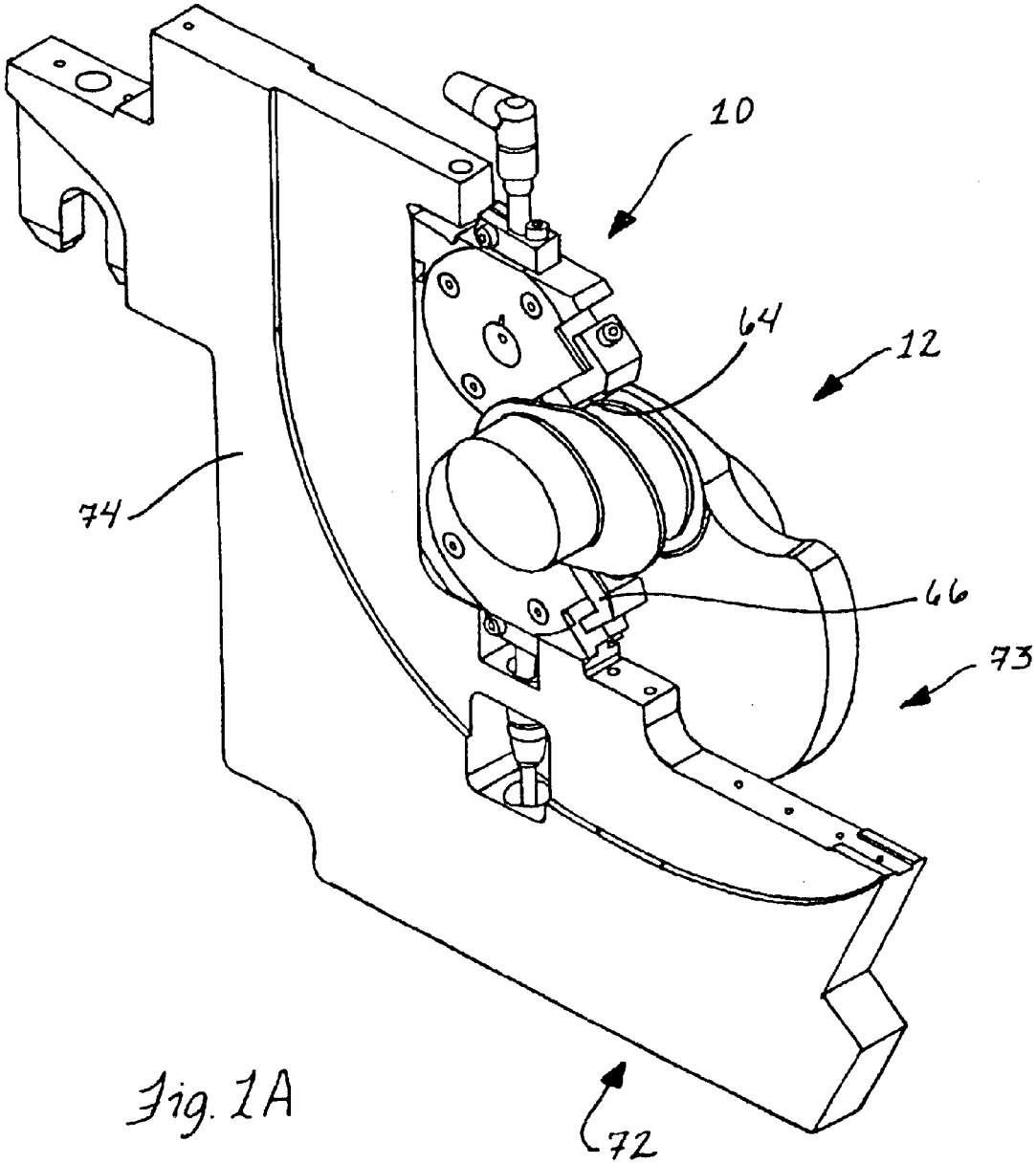
FIG. 1A is a fragmentary perspective view of a rolling arm mounting a tool unit in accordance with the present invention fixed at a forward end of the arm, and a crankshaft to be rolled with work rollers of the unit.

In FIGS. 1A–G and 2, a tool unit 10 employed for roll hardening of crankshafts 12, and particularly those with split-pin bearings 14 (FIG. 4) is shown. As can best be seen in FIGS. 1B, 1E and 2, the tool unit 10 includes work rollers 16 that are rotatably mounted to a housing 18 at positions that are staggered or circumferentially spaced from each other in direction 19 indicated by double-headed arrow extending transverse and, more particularly, normal to crankshaft axis 12*a*. In this manner, when the rollers 16 are engaged against the crankshaft 12, for example in opposite fillets 20*a* and 20*b* on either side of pin bearing 14*a* of the split-pin bearings 14, the work rollers 16 will be at arcuately or circumferentially spaced positions thereabout. Thus, the work rollers 16 will apply roll hardening forces to the fillets 20*a* and 20*b* at any one point in time at positions thereon that are circumferentially spaced from each other. Accordingly, when the pressure level is varied or pulsed between higher and lower levels as the rollers 16 perform rolling operations on the crankshaft fillets 20, the high and low forces, e.g. 12 and 6 KN, respectively, applied by work roller 16*a* will be at circumferential positions about the bearing 14 being rolled that will not correspond to the same circumferential positions of the work roller 16*b* due to their staggered spacing, as described.

Figure 5:
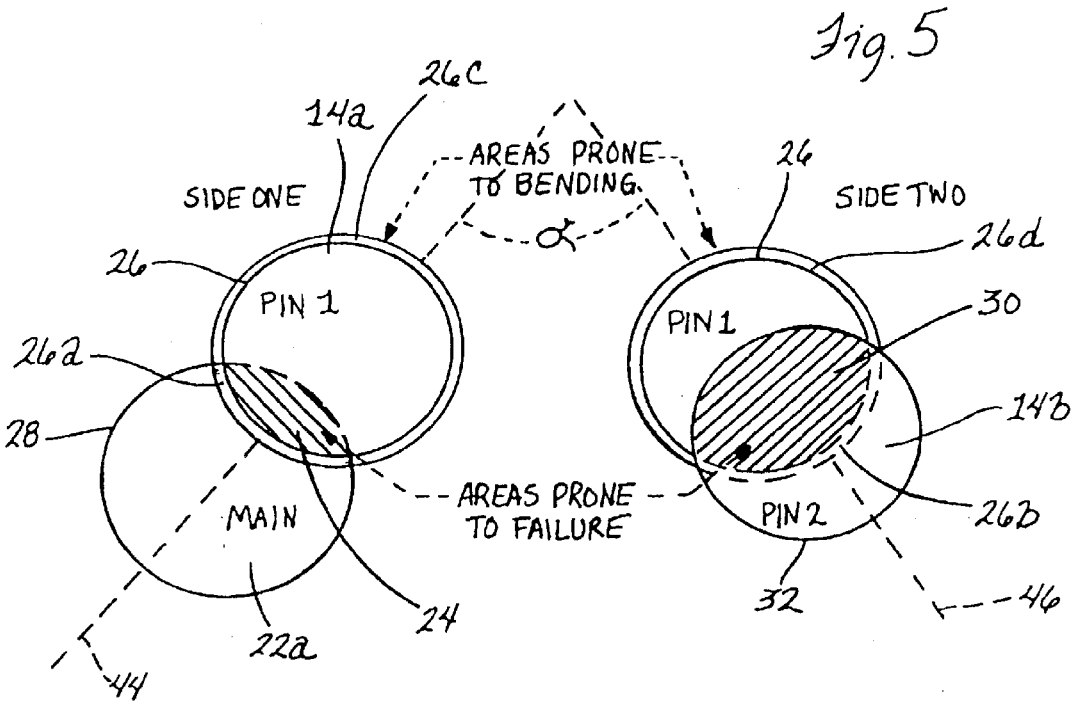
FIG. 5 is a schematic view showing the shaded overlap areas of adjoinment between one of the pin bearings and the adjacent main bearing and between the two split-pin bearings.

This positional arrangement of the work rollers 16 allows the split-pin bearings 14 to be rolled with a variable pressure in a single rolling operation such that in the areas of adjoinment between adjacent bearings where their outer surfaces overlap each other, these arcuate surface portions can be rolled with a higher pressure than those in non-overlapping relation despite the fact that on either side of one of the split-pin bearings 14*a* or 14*b* to be rolled such overlap areas generally are at circumferentially spaced positions relative to each other about the pin bearing. This circumferential or arcuate spacing or offset of the overlap areas is depicted in FIG. 5 with reference to pin bearing 14*a*. As shown, the pin bearing 14*a* and the adjacent main bearing 22*a* have an overlap area 24 of their respective circumferential outer surfaces 26 and 28 that is spaced or offset from the overlap area 30 of the circumferential outer surface 26 of pin bearing 14*a* and outer surface 32 of the adjacent pin bearing 14*b* of the split-pin bearings 14 by being circumferentially shifted about the surface 26 of the pin-bearing 14*a*.

Figure 4:
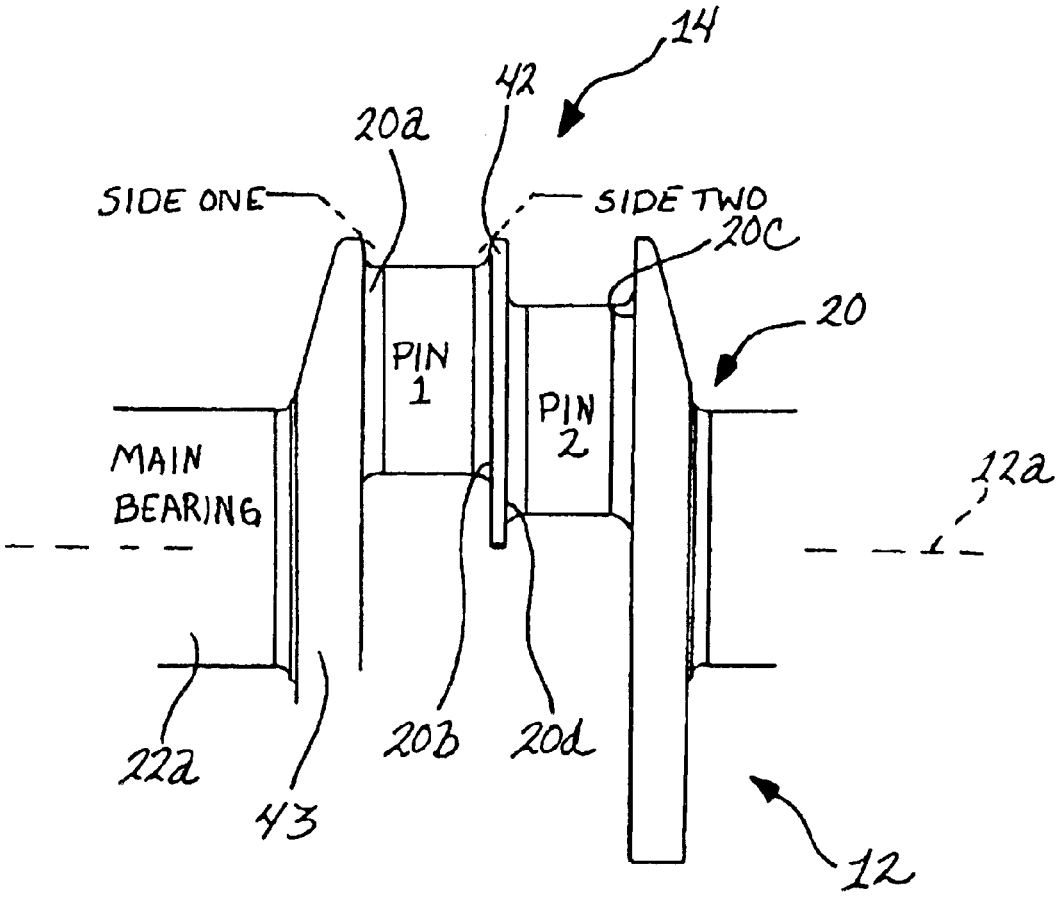
FIG. 4 is an elevational view of a crankshaft having split-pin bearings with a radially extending fence wall therebetween.
Figure 6:
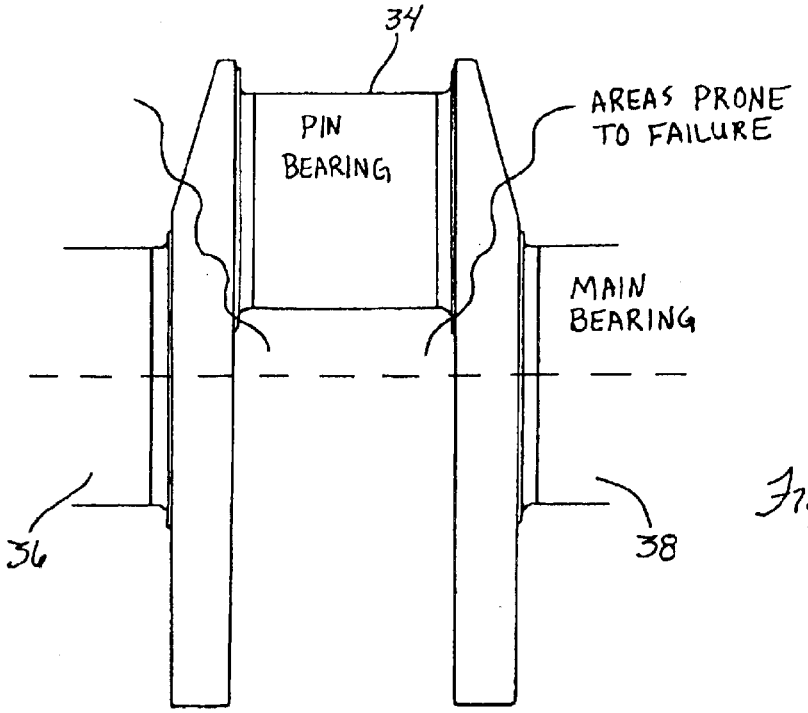
FIG. 6 is a side elevational view of a crankshaft with a single pin bearing between two adjacent main bearings.
Figure 7:
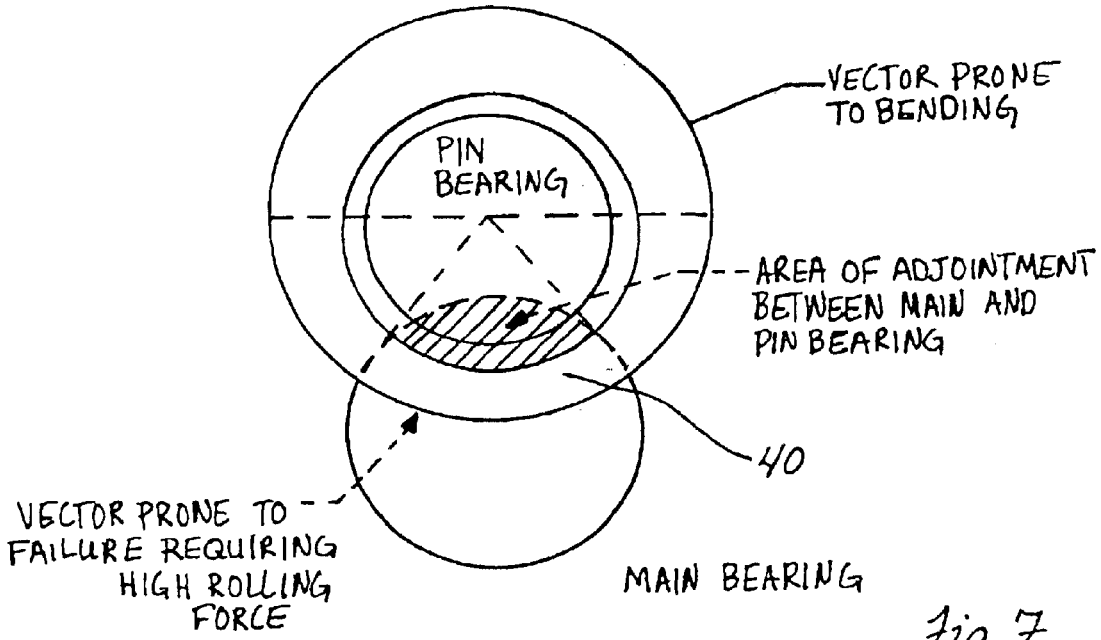
FIG. 7 is a schematic view showing the common overlap area between the pin bearing and either of the main bearings of the crankshaft bearings shown in FIG. 6.

By contrast, FIGS. 6 and 7 show a pin bearing 34 that is flanked by coaxial main bearings 36 and 38 on either side thereof such that the overlap area 40 between the pin bearing 34 and each of the main bearings 36 are exactly corresponding along the same circumferential areas of the fillets 20 therebetween. In the bearing arrangement shown in FIG. 6, a conventional rolling tool unit having work rollers that are aligned with each other in direction 19 can be employed as the overlap area 40 is substantially identical on both sides of the pin bearing 34. On the other hand, with the overlap areas 24 and 30 circumferentially offset or spaced with split-pin bearings 14 as depicted in FIG. 4, only the present tool unit 10 with its offset rollers 16 is able to simultaneously apply the high rolling forces against the surface sections 26*a* and 26*b* extending about the respective circumferentially spaced overlap areas 24 and 30 on either side of the pin bearing 14*a* and to simultaneously apply lower rolling forces against the arcuate or arc surface sections 26*c* and 26*d* extending about the remainder or non-overlap areas on either side of the pin bearing 14*c* without the need for a two-stage rolling process, as previously required with conventional tools. A similar situation will be present when rolling the outboard and inboard fillets 20*c* and 20*d* of the split-pin bearing 14*b* such that another one of the present tool units 10 can advantageously roll the same with varied forces in a single rolling operation as described with respect to bearing 14*a*. Accordingly, only the rolling process with respect to pin bearing 14*a* will be described in detail herein.

Figure 8:
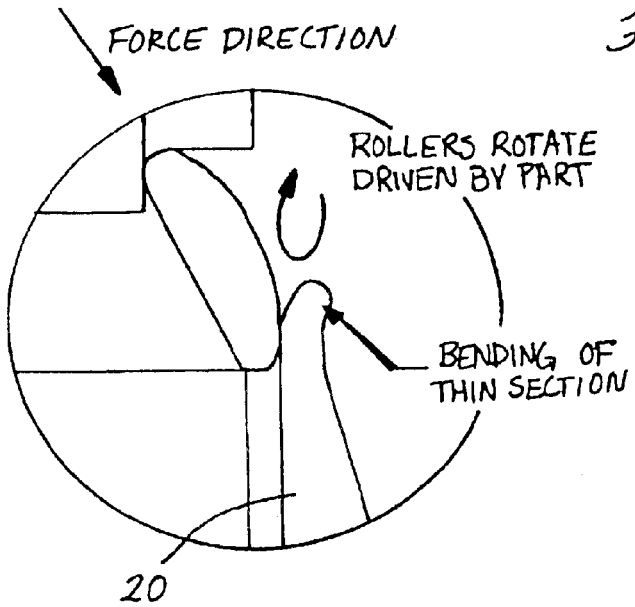
FIG. 8 is an enlarged elevational view showing a work roller engaged in a fillet and causing bending of the radial wall at a non-overlap area between the adjacent bearings due to excessive applied rolling force thereat.

Referring again to FIG. 4, it can be seen that a fence wall 42 extends between the split-pin bearings 14*a* and 14*b* separating the fillets 20*b* and 20*d* thereof. The fence wall 42 extends annularly about substantially the entire circumference of both bearings 14*a* and 14*b* and out radially therefrom so as to project beyond their outer surfaces 26 and 32, respectively. Where the fence wall 42 extends radially from the overlap areas 24 and 30 at respective arc surface sections 26*a* and 26*b*, the rolling forces applied by the rollers 16*a* and 16*b* can be relatively high, e.g. on the order of 12 KN. In these overlap areas, high force rolling can occur without significant fear of causing bending of the wall 42, such as in the non-overlap area depicted in FIG. 8. Accordingly, the arcs or surface sections 26*a* and 26*b* can be rolled with a higher force as they are in the overlap areas 24 and 30 of the pin bearing 14*a* with respect to the main bearing 22*a* and the other split pin bearing 14*b*, respectively. By way of the present tool unit 10, the offset rollers 16 can apply such increased pressure to the surface portions 26*a* and 26*b* simultaneously in the same rolling operation.

In the illustrated split pin bearing configuration, the pin spacing or offset can be defined by the included angle, $\alpha$, as defined between lines 44 and 46 extending normal to the circumferentially offset surface sections 26*a* and 26*b* and through the mid-point thereof. For the rollers 16*a* and 16*b* to be able to simultaneously apply the high rolling forces to the surface sections 26*a* and 26*b*, it is preferred that they also be offset about the pin bearing 14*a* in a similar fashion. More particularly and referencing FIG. 1C, it can be seen that the rollers 16*a* and 16*b* are arcuately spaced such that lines 48 and 50 extending through the respective axes of rotation 52 and 54 of the rollers 16 and intersecting at the center of the bearing they are to roll will define an included angle, $\beta$, therebetween. This angle $\beta$ preferably is substantially the same as the included angle $\alpha$ formed lines by 44 and 46, as previously described. As illustrated, the included angles $\alpha$ and $\beta$ can be approximately seventy-five degrees. In this manner, the offset of the rollers 16 is coordinated with the arcuate spacing of the overlap surface sections 26*a* and 26*b* about the pin bearing 14*a* so as to be able to apply high force levels simultaneously thereto upon relative rotation of the crankshaft 12 and the rollers 16.

In FIG. 5 it can be seen that more of the pin bearings 14*a* and 14*b* are in overlapping relation that the pin bearings 14*a* and adjacent main bearing 22*a*. In this regard, the overlap area 30 between the split-pin bearings 14*a* and 14*b* is larger than the overlap area 24 between the pin bearing 14*a* of the main bearing 22*a*. Thus, the circumferential length of arcuate surface portion 26*a* is longer than that of the arcuate surface portion 26*a*.

Referring to FIG. 4, a radial wall 43, like fence wall 42, extends annularly about the bearings 14*a* and 22*a* and out radially therefrom so as to project beyond their outer surfaces 26 and 28, respectively. However, the wall 43 is thicker and more robust than the fence wall 42 so that concern for bending thereof by application of high rolling forces in the non-overlap areas is not as great as it is with the thinner fence wall 42. Thus, it is preferred that the tool unit 10 be driven with a high pressure so that the entire extent of arc surface portion 26*b* in the fillet 20*b* adjacent the fence wall 42 is rolled with a high force via the work roller 16*a* or 16*b* engaged therewith.

Keeping the high pressure level actuated for a duration sufficient to roll the entire circumferential length of arc surface portion 26*b* necessarily requires that the other roller 16*a* or 16*b* engaged in fillet 20*a* adjacent the main bearing 22*a* will apply high forces to small surface sections on either side of arc surface portion 26*a* that extend into the non-overlapping surface portion 26*c* in the fillet 20*a* of the pin bearing 14*a*. For these small surface sections, application of high force rolling is not of great concern as it will occur adjacent the more robust fence wall 43 between the bearings 14*a* and 22*a* that is less likely to distort under these forces than the pin bearing fence wall 42.

Figure 1B:
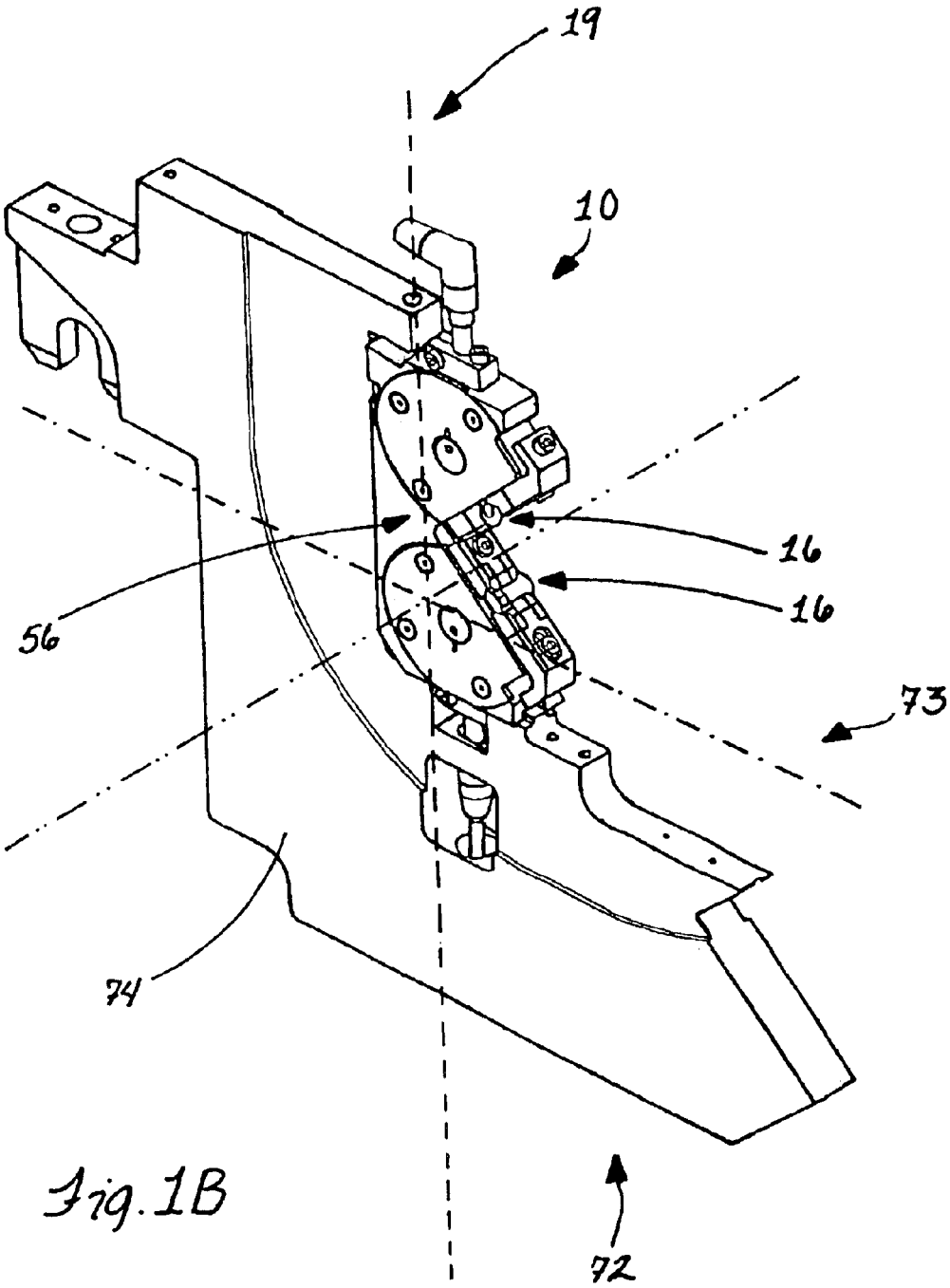
FIG. 1B is a view similar to FIG. 1A with the crankshaft removed.
Figure 1C:
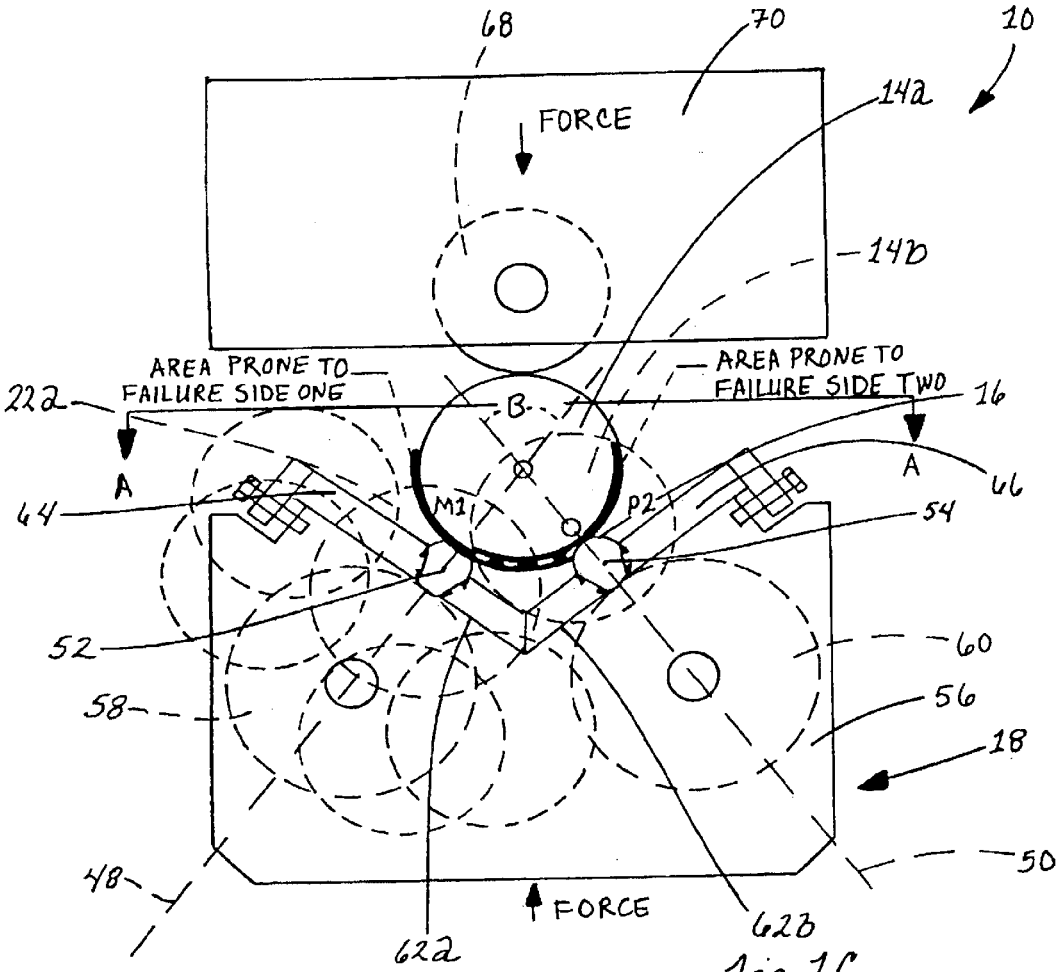
FIG. 1C is a side elevational view of the tool unit of FIG. 1A showing the housing configured to rotatably mount a pair of the work rollers that engage at circumferentially spaced positions about a crankshaft bearing, and a tool housing for a support roller.
Figure 1D:
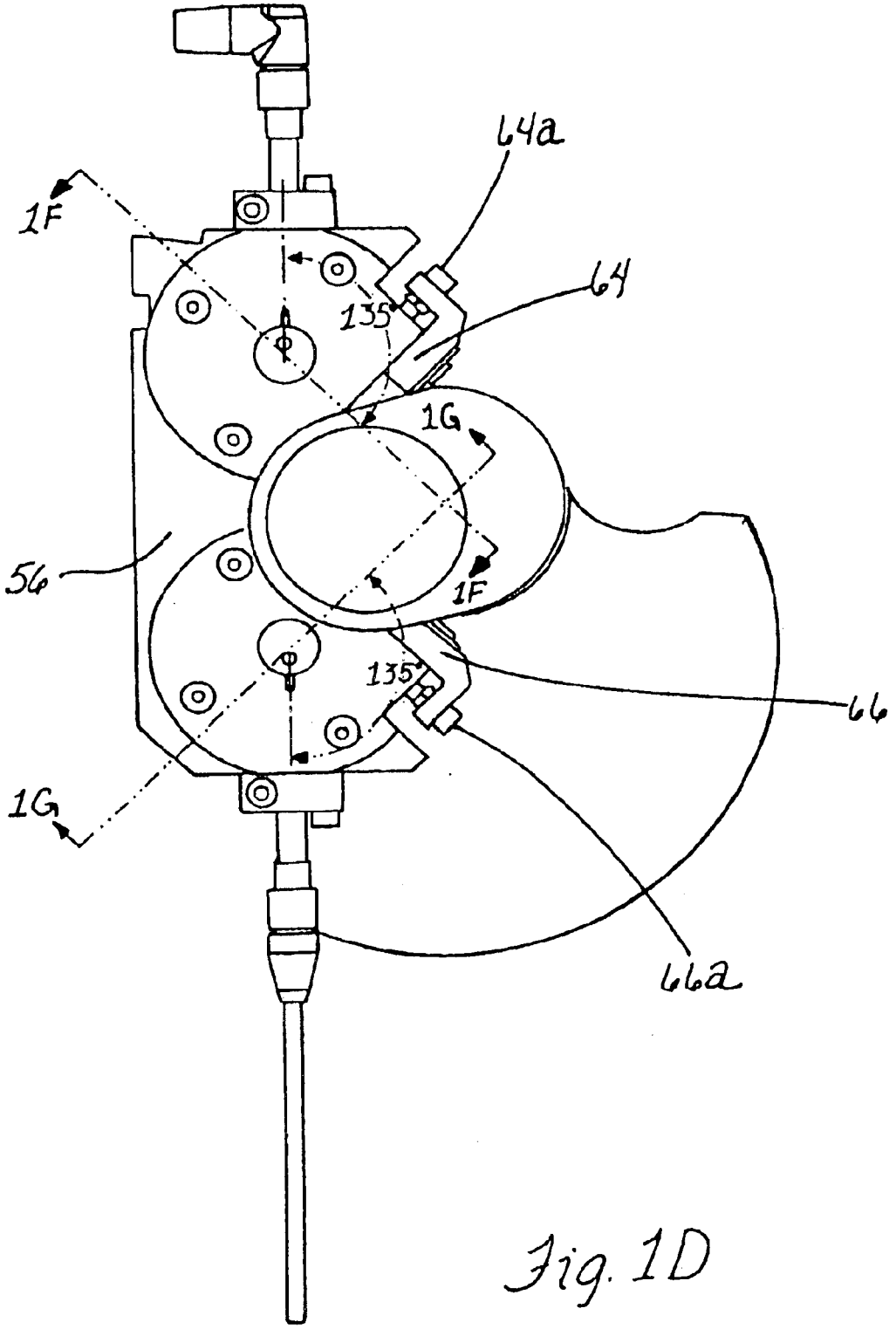
FIG. 1D is a side elevational view of the tool unit of FIGS. 1A and 1C with its work rollers engaged against one of the split-pin bearings of the crankshaft.
Figure 1E:
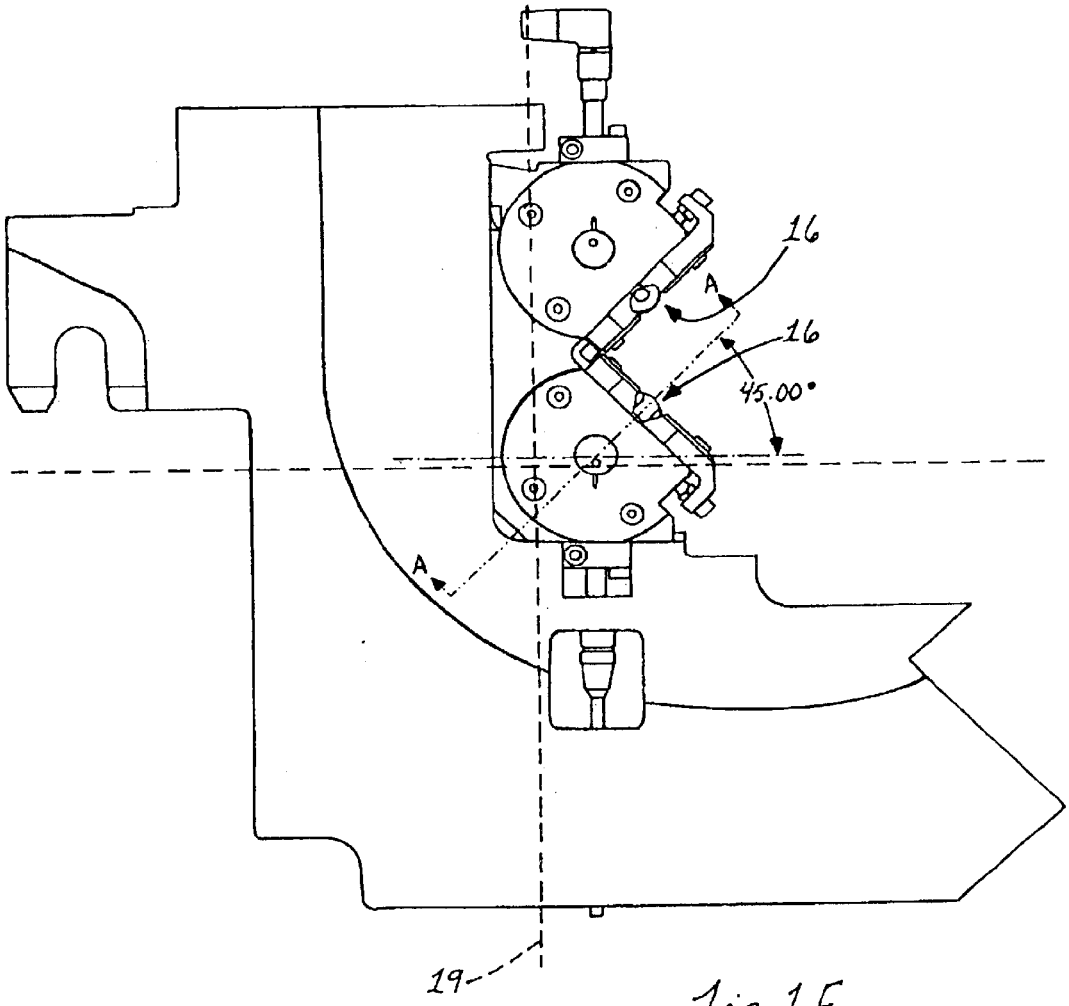
FIG. 1E is a view similar to FIG. 1D showing the tool unit fixed to the arm with the crankshaft removed.
Figure 1F:
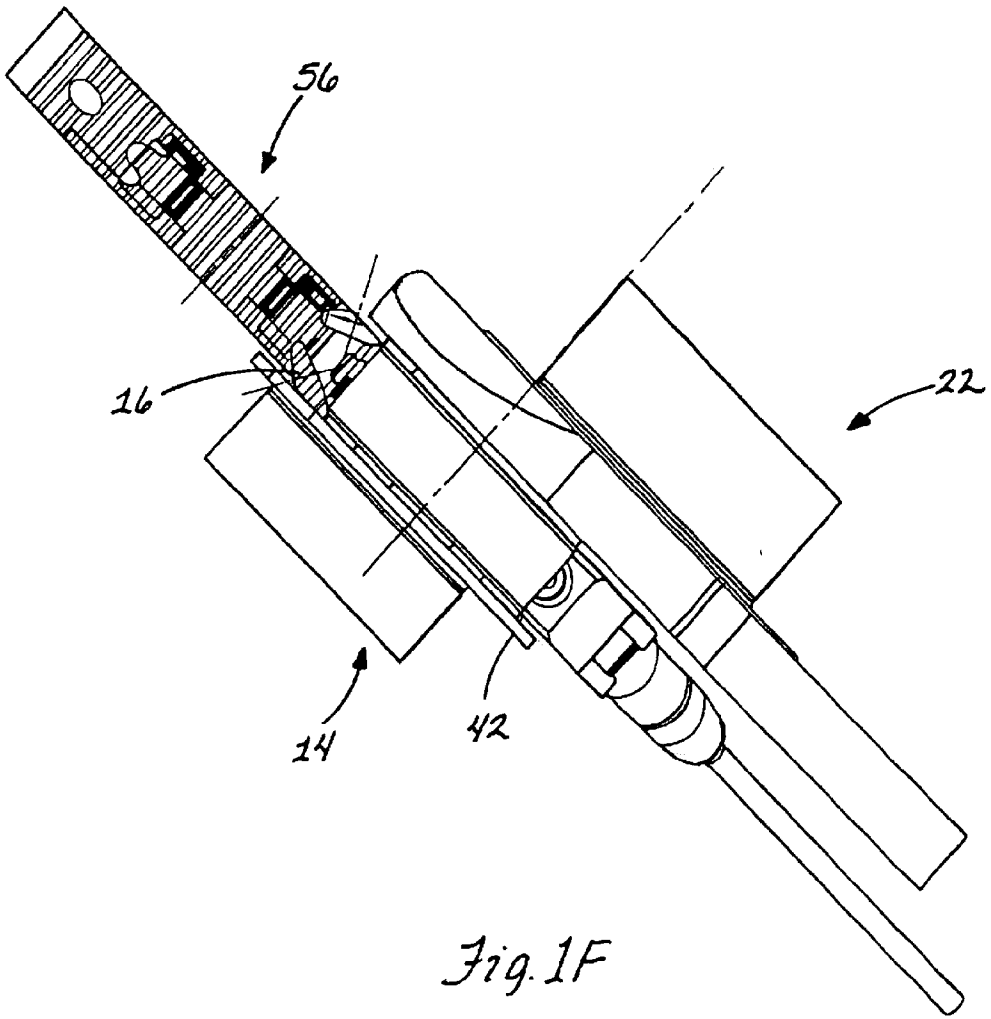
FIG. 1F is a cross-sectional view taken along line 1F—1F of FIG. 1D showing the outward cant of the offset work rollers of the tool unit.
Figure 1G:
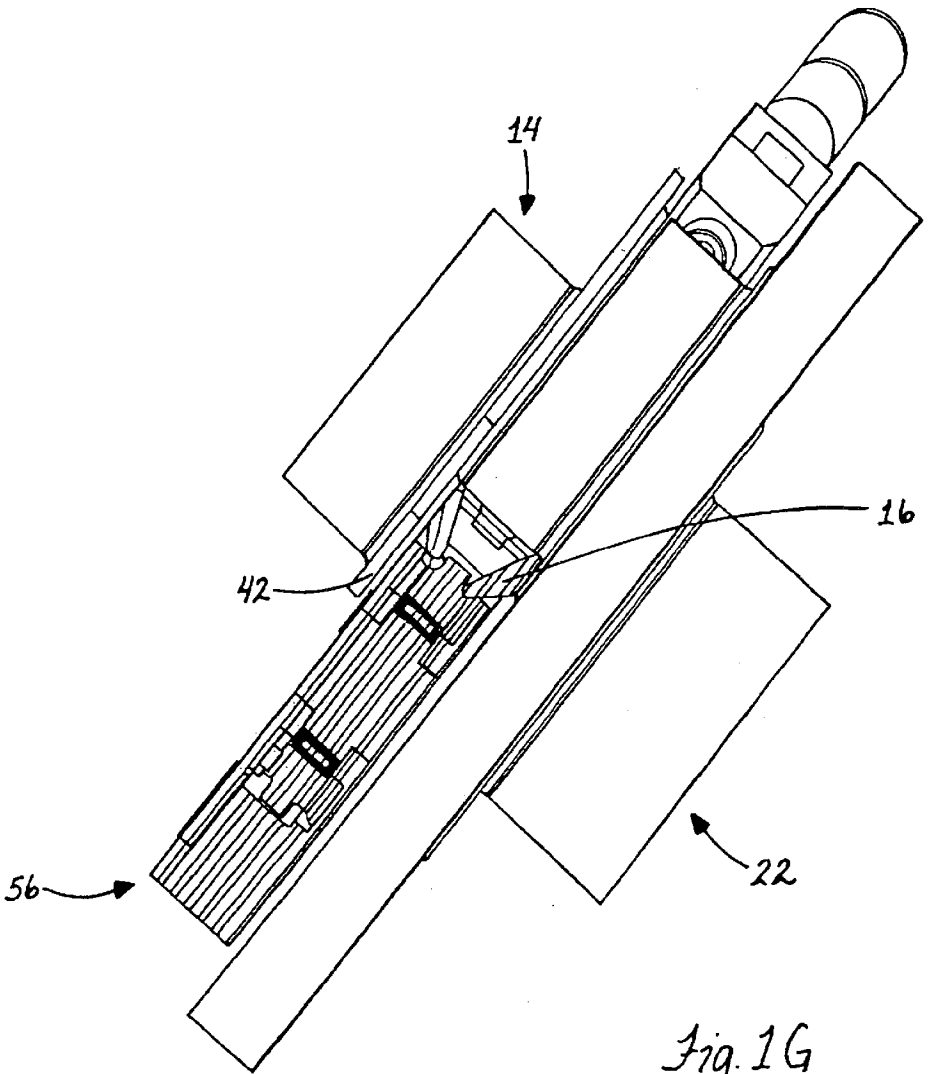
FIG. 1G is a cross-section view taken along line 1G—1G of FIG. 1D showing the outwardly canted work rollers.
Figure 2:
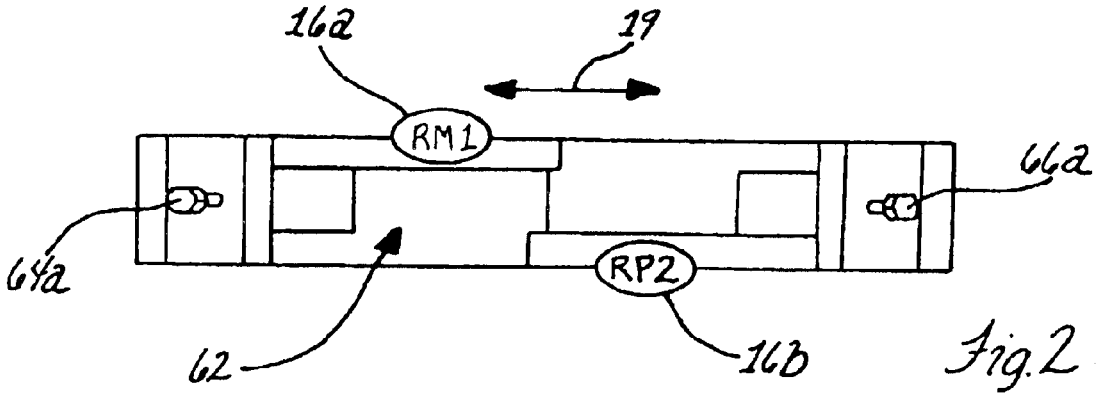
FIG. 2 is an end view of the work roller housing of FIG. 1 showing the offset, circumferentially spaced positions of the work rollers relative to each other.

As shown best in FIGS. 1B, 1E and 1F, housing 18 to which the work rollers 16 are rotatively mounted includes a narrow housing body 56, having a width approximately the same as that of the pin bearing 14. Since the rollers 16 are spaced from each other in direction 19, the housing body 56 preferably contains a backup roller 58 and 60 for each roller 16*a* and 16*b*, respectively. These backup rollers 58 and 60 are rotatively mounted in the housing 56 so as to allow the rollers 16*a* and 16*b* to rotate during crankshaft rolling operations. The rollers 16 project from end 62 of the housing body 56 facing the crankshaft 12. The housing end 62 is configured to allow the rollers 16 to be spaced about the circumference of the pin bearings 14, as previously described. As such, it is preferred that the housing end 62 have a non-linear configuration so that it extends about the bearing to be rolled. In the illustrated form, the housing end 62 has a V-shaped configuration for this purpose. The juncture 63 between angled flank portions 62*a* and 62*b* of the housing end 62 is preferably aligned with the center of the bearing to be rolled, as shown in FIGS. 1C and 3.

To releasably mount the rollers 16 to the housing body 56, a pair of retainers 64 and 66 are employed extending at an angle to each other along each flank portion 62*a* and 62*b* of the V-shaped housing end 62. Each retainer 64 and 66 includes an associated screw clamp 64*a* and 66*a* for releasably securing or clamping the retainers 64 and 66 and rotatively held work roller 16 to the tool housing 56 at the flank portions 62*a* and 62*b* thereof. Thus, the rollers 16*a* and 16*b* each extend from one flank portion 62*a* or 62*b* of the tool housing body 56 and preferably at an outward angle or cant relative to each other for engaging in the opposite side fillets 20 of a bearing. Because of the spacing or offset of the rollers 16 from each other in direction 19, their respective rotation axes 52 and 54 do not intersect each other. And, by way of the above-described canting of the rollers 16 along with their offset in the tool 10, the rotation axes 52 and 54 also do not lie in the same plane, and thus are in non-planar relation to each other.

Figure 3:
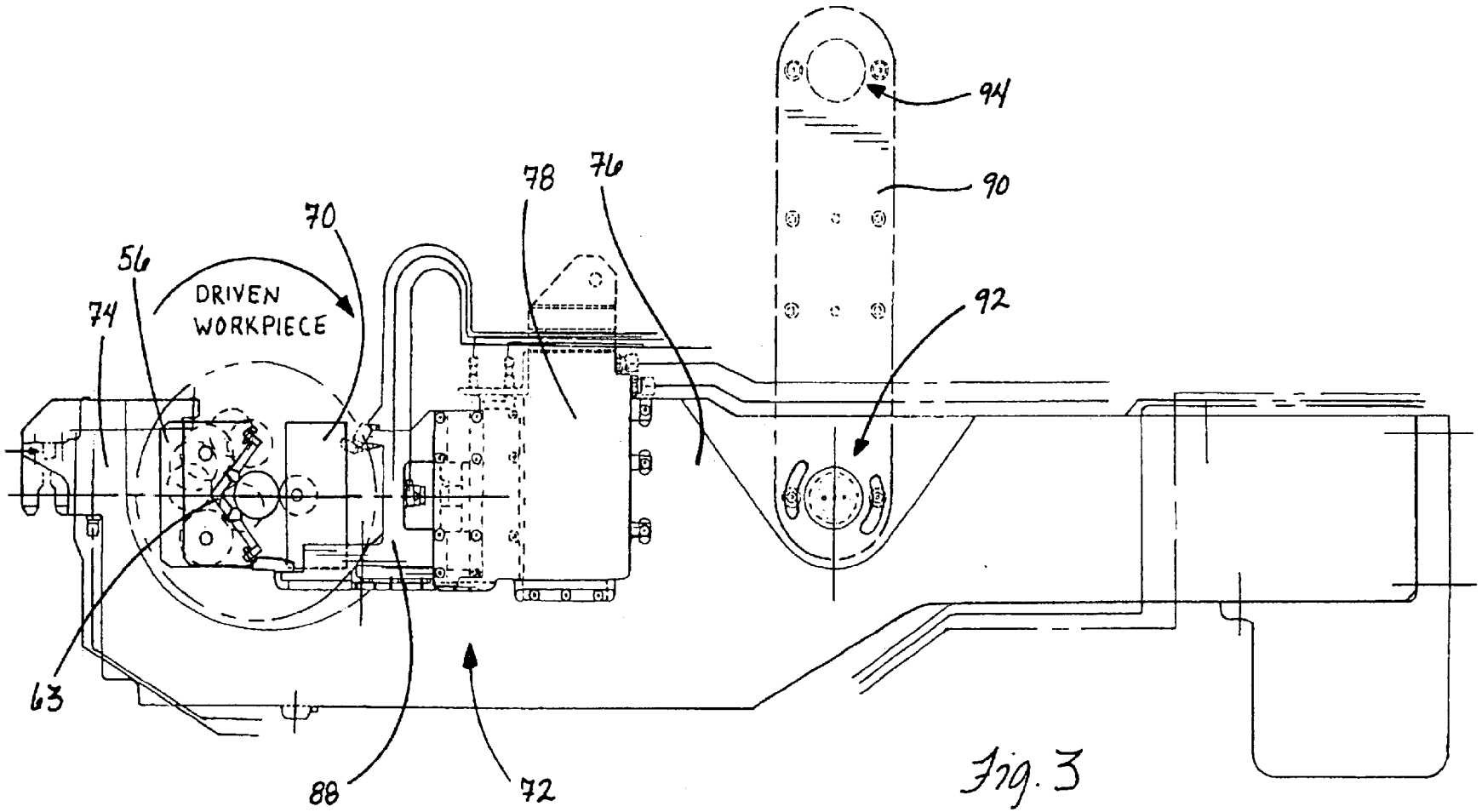
FIG. 3 is an elevational view of a common rolling arm showing the work roller housing and the support roller housing both mounted to the arm, and a pivotal hanger member pivotally connected to the arm.

For generating the rolling forces against the crankshaft 14, a support roller 68 rotatively mounted to housing 70 is clamped against the bearing to be rolled on one side thereof with rollers 16 clamped against the other side of the bearing, as can be seen in FIGS. 1C and 3. In typical scissor arm tools, each tool housing 56 and 70 would be mounted to its own rolling arm that are interconnected intermediate their length by a pivot and are brought toward each other at their forward end where the tools are fixed via power cylinders that operate to generate the clamping or rolling force of the rollers 16 against the crankshaft 14. In the preferred and illustrated form as shown in FIG. 3, the tool housings 56 and 70 are mounted to a common rolling arm 72 as disclosed in applicant's assignees co-pending application, Ser. No. 09/990,182, whose disclosure is incorporated as if reproduced in its entirety herein.

Figure 9:
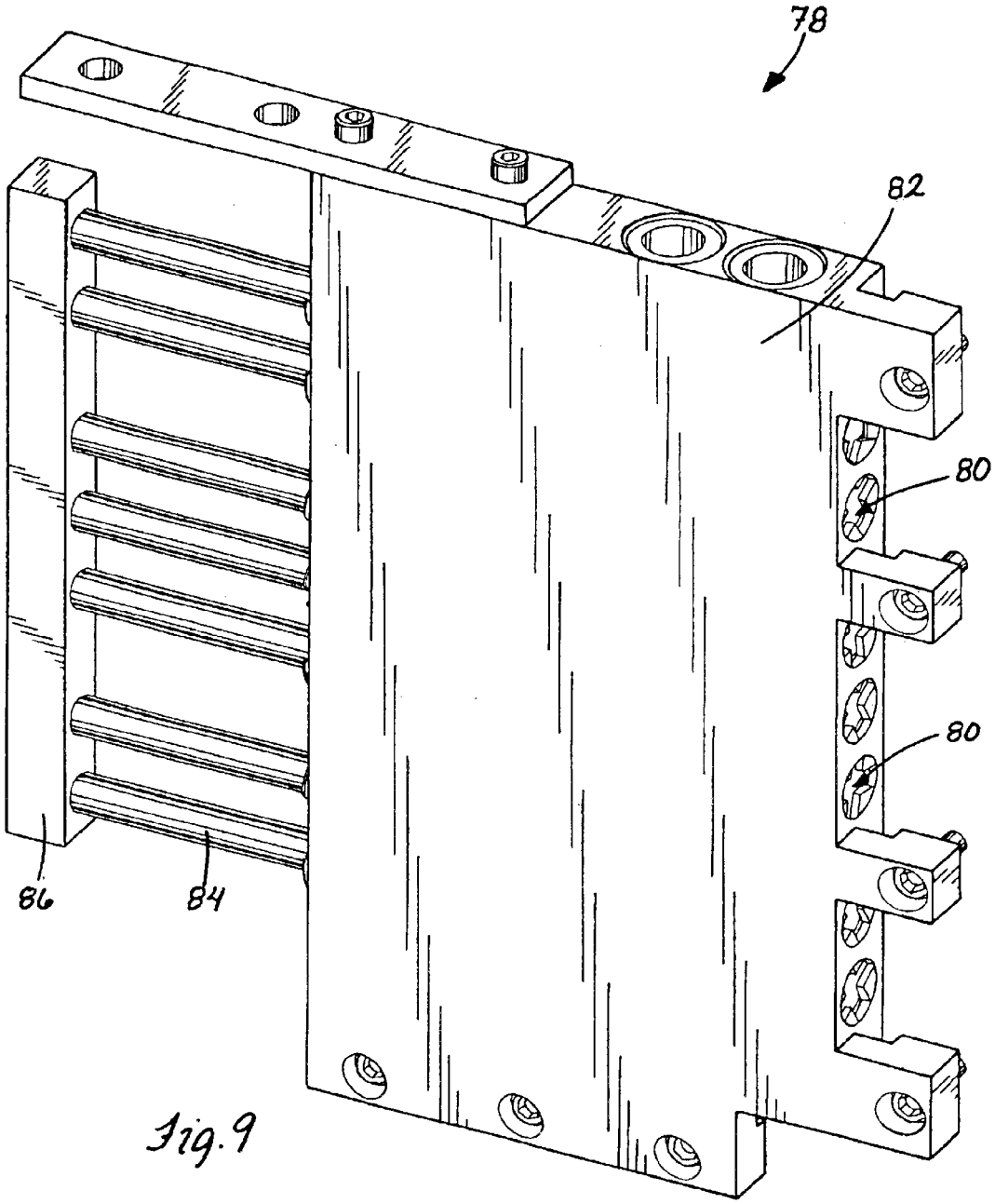
FIG. 9 is a perspective view of a drive cylinder assembly showing a cylinder body having vertically aligned cylinder bores and piston rods in the bores having a tie bar fixed at their outer, forward ends.
Figure 11:
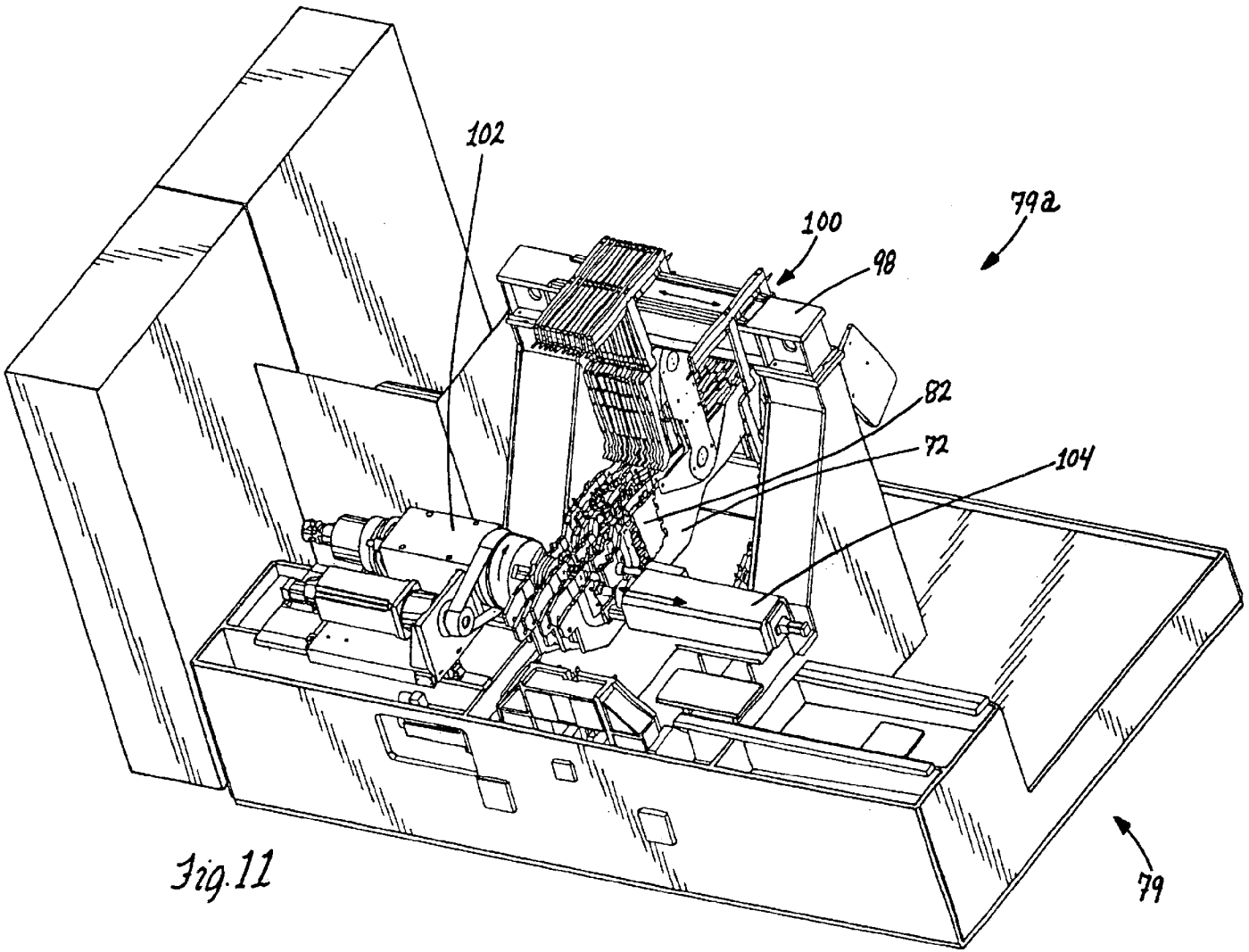
FIG. 11 is a perspective view of a crankshaft rolling apparatus showing the rolling arms generally disposed on one side of the crankshaft for rolling the bearings thereof.

Generally, the arm 72 includes an upwardly opening, generally rectangular cut-out 73 toward the front of the arm 72 and having integral upstanding front and rear portions 74 and 76 at the forward and rearward ends of the cut out 73, as best seen in FIGS. 1A and 3. One of the tool housings 56 or 70 is fixed against the upstanding front arm portion 74 and the other housing 56 or 70 is driven along the length of the arm toward the fixed housing by a drive cylinder assembly 78 (FIG. 9). As shown, the tool housing 56 is fixed and backed by the forward arm portion 74 whereas the tool housing 70 is linearly driven by the cylinder assembly 78 fixed to the arm portion 76. The arm 72 along with the drive cylinder 78 have a very thin width in the axial direction along crankshaft axis 12*a* to allow the arm 72 to be positioned along one side of the crankshaft 12 with each bearing 14 and 22 being rolled simultaneously. In particular, the thin rolling arms 72, e.g. 0.925 inch, allows both split-pin bearings 14*a* and 14*b* to be rolled with tool units 10 mounted to arms 72 that extend side-by-side for the majority of their lengths on one side of the held crankshaft 12. In this fashion, the crankshaft rolling apparatus 79 herein as depicted in FIG. 11 can be much more compact in the direction transverse to the crankshaft axis 12*a*, as no longer do rolling arms have to be positioned on both sides of the crankshaft 12 to simultaneously roll adjacent crankshaft bearings, as in prior rolling machines.

As is apparent, the present crankshaft rolling apparatus 79 is also greatly simplified as there are fewer moving parts versus prior scissor arm machines that employ a pair of arms for rolling each bearing and typically multiple power cylinders for clamping the rollers onto the crankshaft bearings. In contrast, the preferred apparatus herein employs a single arm 72 and cylinder assembly 78 for rolling each bearing. To generate the necessary output force, the cylinder assembly 78 has several small diameter cylinders bores 80, e.g. seven bores, formed in the narrow cylinder body 82 thereof, as shown in FIG. 9. The bores 80 are aligned vertically to keep the width of the cylinder body 82 to a minimum, preferably no greater than that of the arm 72. Pistons and piston rods 84 of the cylinder assembly 78 are fixed together as by tie bar 86 and connected to a saddle 88 that carries the support roller housing 70, with the saddle 88 mounted for linear sliding along bearings attached at the bottom of the cut out 73 of the arm 72. Accordingly, with the arm 72 positioned so that the bearing to be rolled is generally centered with the support roller 68 and the middle juncture 63 of the tooling unit housing 56, the drive cylinder 78 is actuated as by supply of high pressure power fluid to the bores 80 thereof causing the saddle 88 and support roller housing 70 to shift toward the bearing clamping it between the work rollers 16 and the support roller 68.

Figure 10:
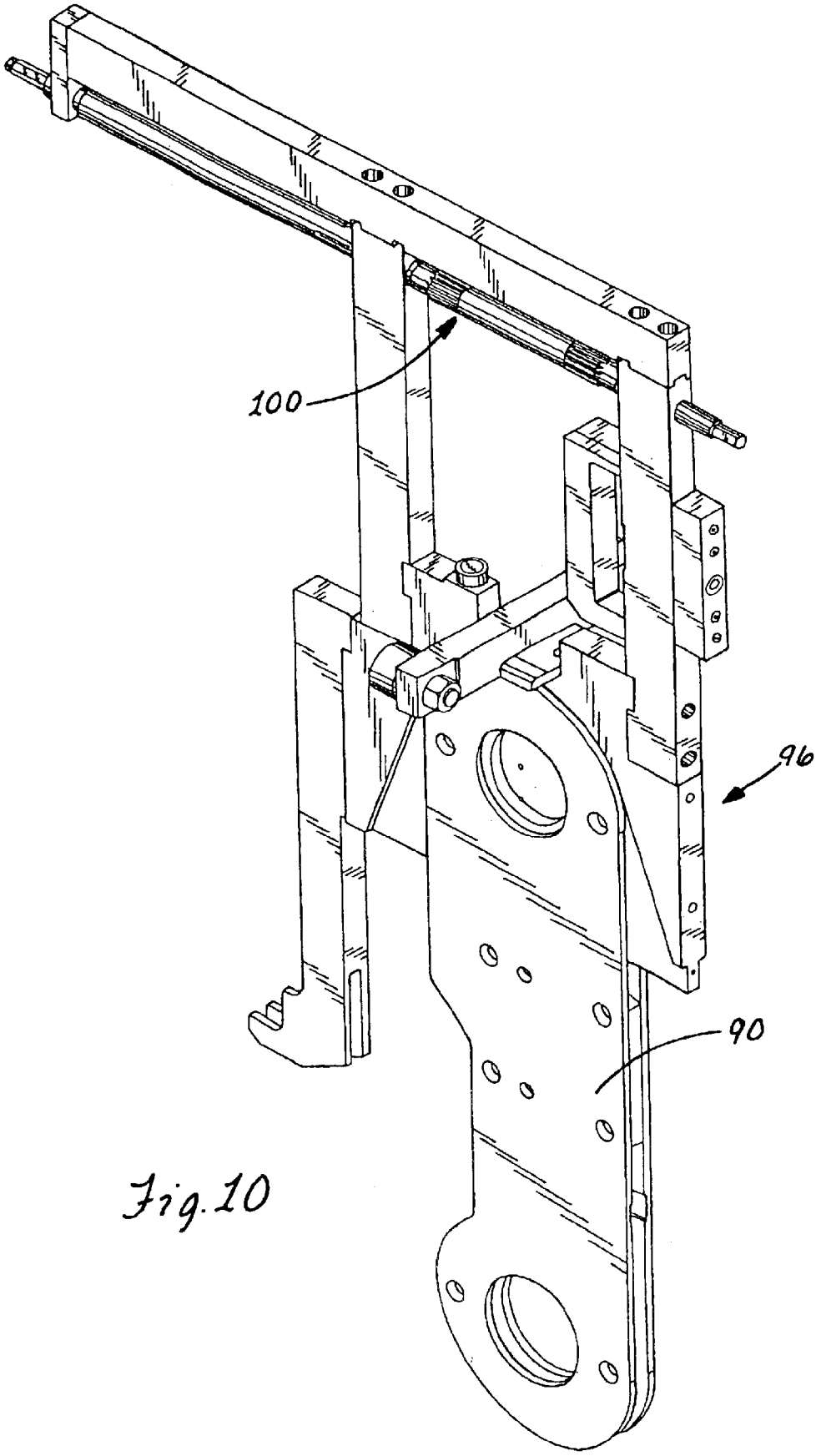
FIG. 10 is a perspective view of a suspension structure showing the hanger member pivotally connected thereto toward its upper end.

Turning to more of the details, the rolling arms 72 are pivotally supported by a hanger member 90 so as to enable the arm 72 to follow the eccentric path of the pin bearings 14 during crankshaft rotation. To this end, the hanger member 90 is pivotably connected to the arm 72 at a lower pivot connection 92 thereof, and includes an upper pivot connection 94 to a suspension structure 96 (FIG. 10) which can be shifted along upper bridge 98 as by a rack and pinion gear arrangement 100 for axial arm adjustments for differently configured and sized crankshafts 12. The arm 72 pivots vertically up and down about the lower pivot connection 82 and in a fore and aft direction by way of the upper pivot connection 84. Such orbital pivoting of the arm 72 will occur with the rollers 16 and 68 clamped onto the pin bearing 14, for example, and the crankshaft 12 held at its ends by head and tail stock units 102 and 104, respectively, and rotated thereby as by operation of rotary drive(s) thereof. As shown in FIG. 11, the units 102 and 104 are mounted toward the front of the preferred rolling machine 79 with all of the rolling arms 72 extending rearwardly in side-by-side orientation to each other except for the upstanding front portion 74 thereof so that the majority of the length of the arms 72 along with the hanger members 90, suspension structures 96 and bridge 98 are disposed toward the rear 79*a* of the machine on one side of the held crankshaft 12. Because of the narrow width of the arms 72 and associated components, each bearing 14 or 22 of the crankshaft 12 can be rolled in a single rolling operation with the arms 72 disposed to one side 79*a* of the crankshaft 12, as described.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A rolling tool unit for an apparatus for roll hardening crankshafts having offset, adjacent pin bearings, the tool unit comprising:

a tool housing; and a pair of work rollers rotatively mounted to the housing at predetermined positions such that the rollers are arcuately spaced from each other about one of the adjacent pin bearings and axially spaced from each other across the one pin bearing with the rollers not being in axial alignment across the one pin bearing due to the arcuate spacing therebetween so that each roller lacks a corresponding axially aligned roller across the bearing.

2. The tool unit of claim 1 wherein the tool housing includes a pair of back-up rollers in the tool housing with each back-up roller rotatively supporting one of the work rollers.

3. The tool unit of claim 1 wherein the tool housing has an end facing the crankshaft from which the work rollers project with the end being configured to extend about the crankshaft bearing.

4. The tool unit of claim 3 wherein the tool housing end has a generally v-shaped configuration.

5. The tool unit of claim 1 wherein the work rollers rotate about respective axes with the predetermined positions of the rollers arranged so that the roller axes are in non-intersecting relation to each other.

6. The tool unit of claim 5 wherein the work rollers are oppositely canted relative to each other so that the roller axes are in non-planar relation to each other.

7. A rolling tool unit for an apparatus for roll hardening crankshafts having offset, adjacent pin bearings, the tool unit comprising:

a tool housing;

a pair of work rollers rotatively mounted to the housing at predetermined positions such that the rollers are arcuately spaced from each other about one of the adjacent pin bearings; and a power actuator operable to clamp the work rollers against the pin bearing fillets with a predetermined varied rolling force including a high force with the spaced rollers disposed against bearing surface portions in adjoinment areas between the adjacent pin bearings and the one pin bearing and the adjacent main bearing where the bearings overlap each other, and a low force against bearing surface portions in non-overlap areas.

8. The tool unit of claim 7 wherein the power actuator comprises a power cylinder, a rolling arm on which the power cylinder and tool housing are mounted, and another tool housing having a support roller for clamping the crankshaft between the work and support rollers with both tool housings mounted on the same rolling arm.

9. A method for roll hardening offset, adjacent pin bearings of crankshafts, the method comprising:

applying a first work roller against a fillet on one side of one of the adjacent pin bearings;

applying a second work roller against another fillet on the other side of the one pin bearing at a position that is circumferentially spaced from the first work roller;

simultaneously rolling the first and second rollers against circumferentially spaced positions along the respective pin bearing fillets upon relative rotation between the crankshaft and the rollers.

10. The method of claim 9 including varying the force applied by the rollers to the circumferentially spaced positions on the fillets between high force levels in adjoinment areas between adjacent bearings where the bearings overlap each other and low force levels in non-overlap areas.

11. The method of claim 9 wherein the first and second work rollers are applied simultaneously to the opposite fillets on either side of the pin bearing.

12. The method of claim 9 including carrying the first and second work rollers in a single housing to provide a single rolling tool unit that simultaneously rolls circumferentially spaced positions along the fillets on opposite sides of the one pin bearing.

13. The method of claim 12 including providing a support roller rotatively mounted in a tool housing that is mounted to a single pivotal rolling arm which also mounts the work roller housing thereon, and shifting at least one of the work roller housing and support roller housing along the rolling arm to clamp the pin bearing between the work rollers and the support roller.

* * * * *